US007156108B2

(12) United States Patent
Xin

(10) Patent No.: US 7,156,108 B2
(45) Date of Patent: Jan. 2, 2007

(54) MULTIFUNCTION DENTAL CLEANING DEVICE

(76) Inventor: Alfred Xueliang Xin, 6310 Copperleaf La., Cincinnati, OH (US) 45230

( * ) Notice: Subject to any disclaimer, the term of this patent is extended or adjusted under 35 U.S.C. 154(b) by 404 days.

(21) Appl. No.: 10/409,300

(22) Filed: Apr. 7, 2003

(65) Prior Publication Data

US 2004/0194797 A1 Oct. 7, 2004

(51) Int. Cl.
*A61C 15/00* (2006.01)

(52) U.S. Cl. ..... 132/322; 15/22.1

(58) Field of Classification Search ..... 132/309, 132/322, 323; 433/118; 15/22.1, 22.2; 310/47, 310/48, 50, 80, 40 MM, 75 R
See application file for complete search history.

(56) References Cited

U.S. PATENT DOCUMENTS 3,489,936 A * 1/1970 Boyles ..... 310/47
3,546,501 A * 12/1970 Kircher ..... 310/50
4,791,945 A * 12/1988 Moriyama ..... 15/22.1
5,253,382 A * 10/1993 Beny ..... 15/22.1
5,261,430 A * 11/1993 Mochel ..... 132/322
5,636,988 A * 6/1997 Murayama ..... 433/118
RE35,712 E * 1/1998 Murayama ..... 132/322
RE36,699 E * 5/2000 Murayama ..... 433/118

* cited by examiner

*Primary Examiner*—Todd E. Manahan
(74) *Attorney, Agent, or Firm*—Douglas E. Mackenzie

(57) ABSTRACT

A multifunction dental cleaning device is disclosed. The device includes a housing and a drive mechanism disposed within the housing. The drive mechanism includes a driven gear having eccentrically disposed thereon a pin. A reciprocator is coupled to the drive mechanism and includes a U-shaped body having a bridge end and a housing end. The reciprocator further includes a reciprocating bridge slidingly disposed between a pair of supports formed at the bridge end of the reciprocator, the reciprocating bridge including a slot adapted to receive the pin. The reciprocator is rotatably attached to the housing at the bridge end for rotation between a vertical mode motion position and the horizontal mode motion position. A rocker arm is coupled to the reciprocator, and one of a flossing head and a brushing head are coupleable to the rocker arm. Manual rotation of the reciprocator between the vertical mode motion position and the horizontal mode motion position imparts vertical and horizontal motion of the rocker arm respectively.

5 Claims, 14 Drawing Sheets

MULTIFUNCTION DENTAL CLEANING DEVICE

BACKGROUND OF THE INVENTION

This invention relates to dental cleaning devices and more particularly to a multifunction dental cleaning device capable of flossing and brushing teeth and the spaces between teeth from a variety of angles and directions.

Devices for brushing and flossing teeth and the spaces between teeth are well known in the prior art. For example, flossing devices are disclosed in U.S. Pat. Nos. 5,678,578, 6,065,479, 6,076,535, 6,079,424, 6,092,536, 6,155,274, 6,253,774, 6,363,949, and 6,382,219. It is also known in the art to combine a brush or bristle assembly with a flossing assembly as disclosed in U.S. Pat. Nos. 5,676,167 and 6,095,157 and further to provide a powered brush that both flosses and brushes at the same time as disclosed in U.S. Pat. No. 5,749,380. Finally, teeth brushing devices for mechanically moving the bristles and/or the brush assembly are known in the prior art as disclosed in U.S. Pat. Nos. 5,604,735 and 5,974,615.

As can be seen, there is a need for a multifunction dental cleaning device capable of flossing and brushing teeth and the spaces between teeth from a variety of angles and directions.

SUMMARY OF THE INVENTION

In accordance with the present invention, a multifunction dental cleaning device includes a housing, a drive mechanism disposed within the housing, a reciprocator coupled to the drive mechanism, a rocker arm coupled to the reciprocator, and one of a flossing head and a brushing head coupleable to the rocker arm.

In accordance with an alternate embodiment of the present invention, a multifunction dental cleaning device includes a housing, a drive mechanism disposed within the housing, and an reciprocator coupled to the drive mechanism, the reciprocator being adjustable to impart vertical motion to a one of the flossing head and a brushing head in a vertical mode motion position and adjustable to impart horizontal motion to the one of the flossing head and the brushing head in a horizontal mode motion position, the one of the flossing head and the brushing head being coupleable to a rocker arm coupled to the reciprocator.

In accordance with an alternate embodiment of the present invention, a multifunction dental cleaning device includes a housing, a drive mechanism disposed within the housing; an reciprocator coupled to the drive mechanism, the reciprocator being adjustable to impart vertical motion to a one of the flossing head and a brushing head in a vertical mode motion position and adjustable to impart horizontal motion to the one of the flossing head and the brushing head in a horizontal mode motion position, the one of the flossing head and the brushing head being coupleable to a rocker arm coupled to the reciprocator, and a pivot mechanism, the pivot mechanism disposed between the reciprocator and the one of the flossing head and the brushing head, the pivot mechanism providing a pivot point for the rocker arm in the vertical mode motion position.

These and other features, aspects and advantages of the present invention will become better understood with reference to the following drawings, description and claims.

DETAILED DESCRIPTION OF THE INVENTION

The following detailed description is of the best currently contemplated modes of carrying out the present invention. The description is not to be taken in a limiting sense, but is made merely for the purpose of illustrating the general principles of the invention, since the scope of the invention is best defined by the appended claims.

Figure 1:
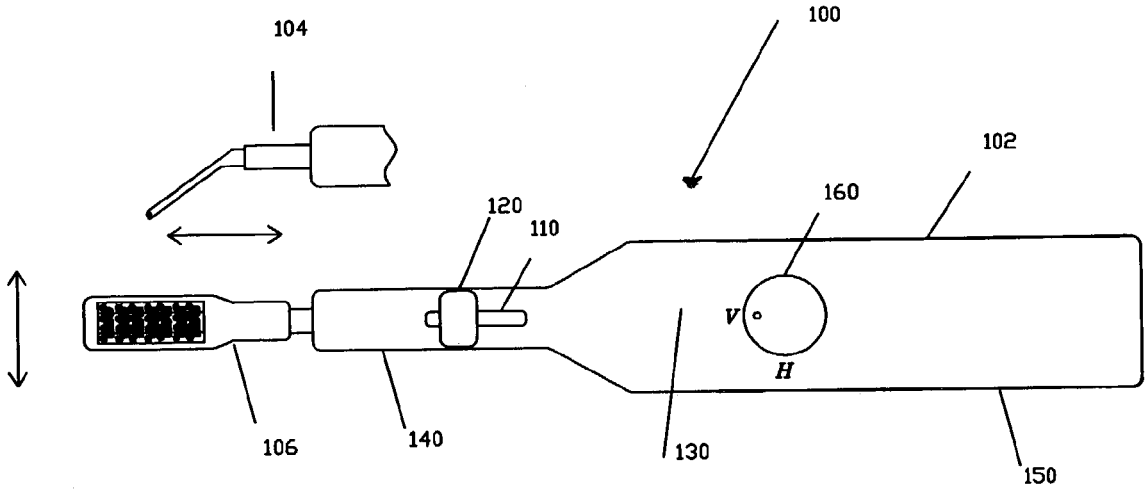
FIG. 1 is a fragmental side elevation view of a multifunction dental cleaning device in accordance with an embodiment of the invention.

Referring now to the drawings in detail, and particularly FIG. 1, a preferred embodiment of a multifunction dental cleaning device generally designated 100 is shown including an elongated housing 102 for housing a drive mechanism generally designated 490 (FIG. 4) as further described herein. A flossing head 104 and a brushing head 106 may be alternatively attached to a rocker arm 460 (FIG. 4) to achieve both vertical and horizontal motion of the flossing head 104 and the brushing head 106 respectively.

Figure 4:
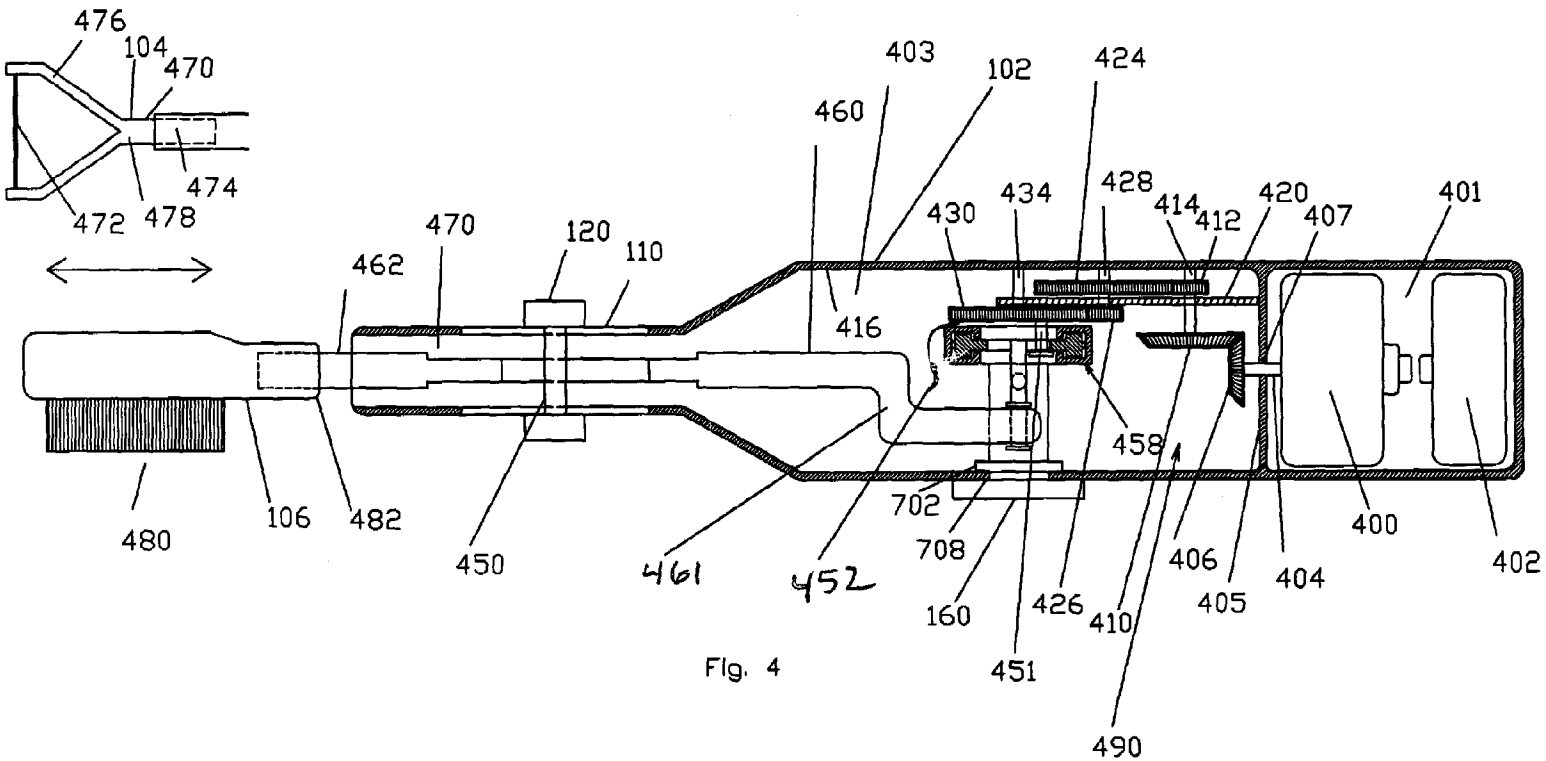
FIG. 4 is a top elevation view, partly in section, of the multifunction dental cleaning device of FIG. 1 showing a drive mechanism in accordance with the invention.

The elongated housing 102 further includes a sliding slot 110 for accommodating a positionable pivot pin 450 (FIG. 4). A pair of handles 120 (FIG. 1) are attachable to either end of the pivot pin 450 and are shown disposed adjacent an outside surface 130 of the elongated housing 102 proximate a narrow portion 140 of the elongated housing 102. The function of the pivot pin 450 and the handles 120 will be further described herein. Disposed proximate a wide portion 150 of the elongated housing 102 is shown an adjusting button 160 for selecting between vertical and horizontal motion modes of the flossing head 104 and the brushing head 106 as further described herein.

Figure 6:
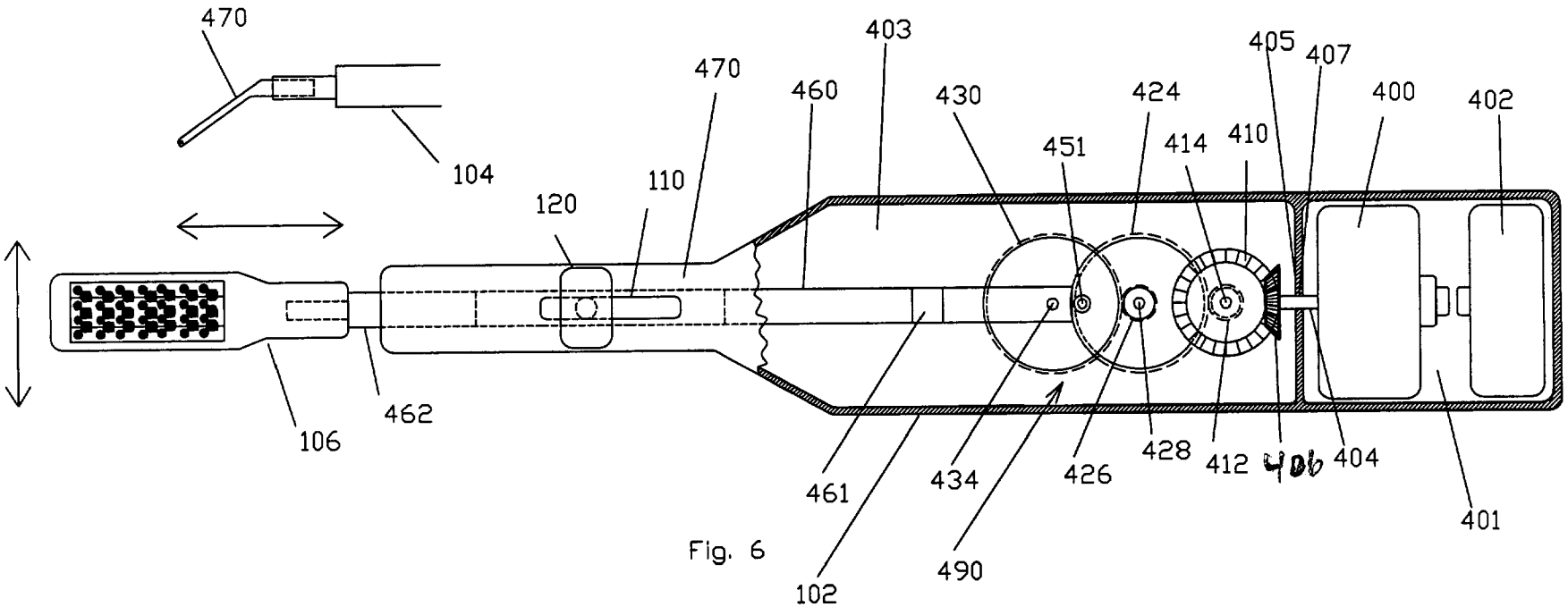
FIG. 6 is a side elevation view, partly in section, of the multifunction dental cleaning device of FIG. 1 showing the drive mechanism in accordance with the invention.

With reference to FIGS. 4 and 6, a preferred embodiment of the present invention is shown including drive mechanism 490 which may include a motor 400 disposed within the elongated housing 102 in a motor/battery compartment 401. The motor/battery compartment 401 may be separated from a gear compartment 403 by a wall 405. The motor 400 may be powered by a battery 402 coupled to the motor 400 through a switch (not shown).

The motor 400 is shown including a motor drive shaft 404 for coupling the motor 400 to a first bevel pinion gear 406. Drive shaft 404 extends through wall 405 through an aperture 407. The first bevel pinion gear 406 is coupled to a first driven bevel gear 410 which in turn is coupled to a first spur gear 412 by means of a first gear shaft 414. First gear shaft 414 is bearingly coupled to an inside wall 416 of the elongated housing 102 and to a gear supporting structure 420 shown extending from the wall 405 into the gear compartment 403.

First spur gear 412 is coupled to a first driven gear 424 which in turn is coupled to a second spur gear 426 by means of a second gear shaft 428. Second gear shaft 428 is bearingly coupled to the inside wall 416 and to the gear supporting structure 420.

Second spur gear 426 is coupled to a second driven gear 430, the second driven gear 430 being positioned within the gear compartment 403 by means of a third gear shaft 434. Third gear shaft 434 is bearingly coupled to the inside wall 416 and to the gear supporting structure 420.

The second driven gear 430 is shown including a pin 451 eccentrically disposed on a bottom surface 452 thereof. Pin 451 is engageable to a reciprocator generally designated 458 which will be described in further detail with reference to FIGS. 7–9.

With continued reference to FIGS. 4 and 6, the rocker arm 460 is shown extending from the reciprocator 458 through the gear compartment 403 into a forward compartment 470. Rocker arm 460 includes a jogged portion 461. Flossing head 104 and the brushing head 106 are attachable to an attachment end 462 of the rocker arm 460 as further described herein.

Figure 5:
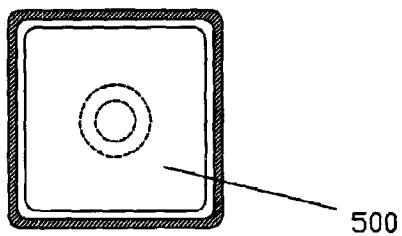
FIG. 5 is a rear elevation view of the multifunction dental cleaning device of FIG. 1.

With reference to FIG. 5, a back portion 500 of the elongated housing 102 is shown having a generally square profile. Back portion 500 may be removeable or openable to replace battery 402 in any conventional manner well known in the art.

With particular reference to FIG. 6, the drive mechanism 490 of the embodiment shown in FIG. 4 is shown from a top perspective. Drive shaft 404 is shown coupling the motor 400 to the first bevel pinion gear 406. The first bevel pinion gear 406 is shown coupled to the first driven bevel gear 410 which in turn is coupled to the first spur gear 412 by means of the first gear shaft 414. First spur gear 412 is coupled to the first driven gear 424 which in turn is coupled to the second spur gear 426 by means of the second gear shaft 428. Finally, second spur gear 426 is coupled to the second driven gear 430, the second driven gear 430 being positioned within the gear compartment 403 by means of the third gear shaft 434.

Figure 7:
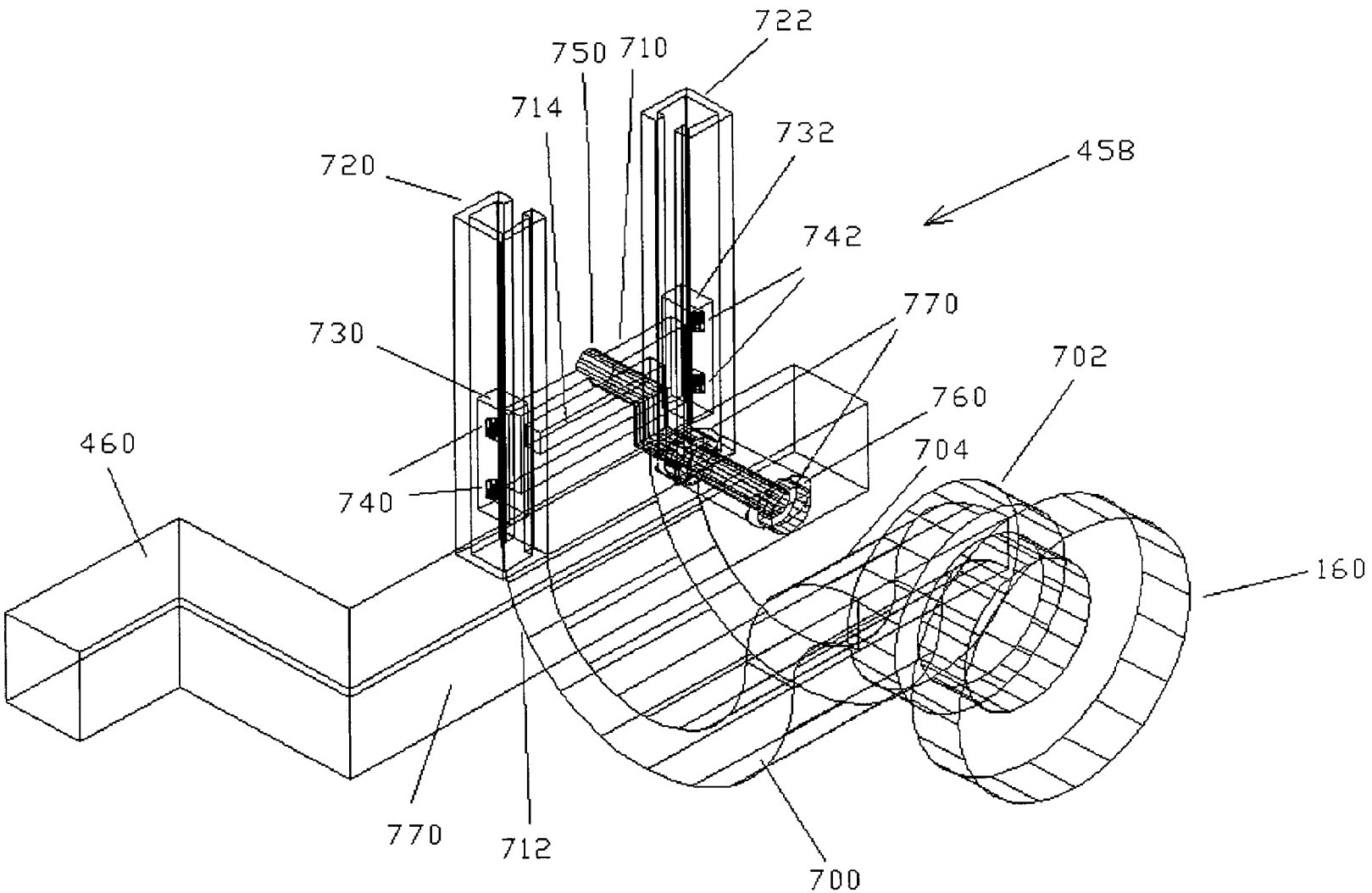
FIG. 7 is a fragmental perspective view of a reciprocator in accordance with an embodiment of the invention shown in ghost image.
Figure 8:
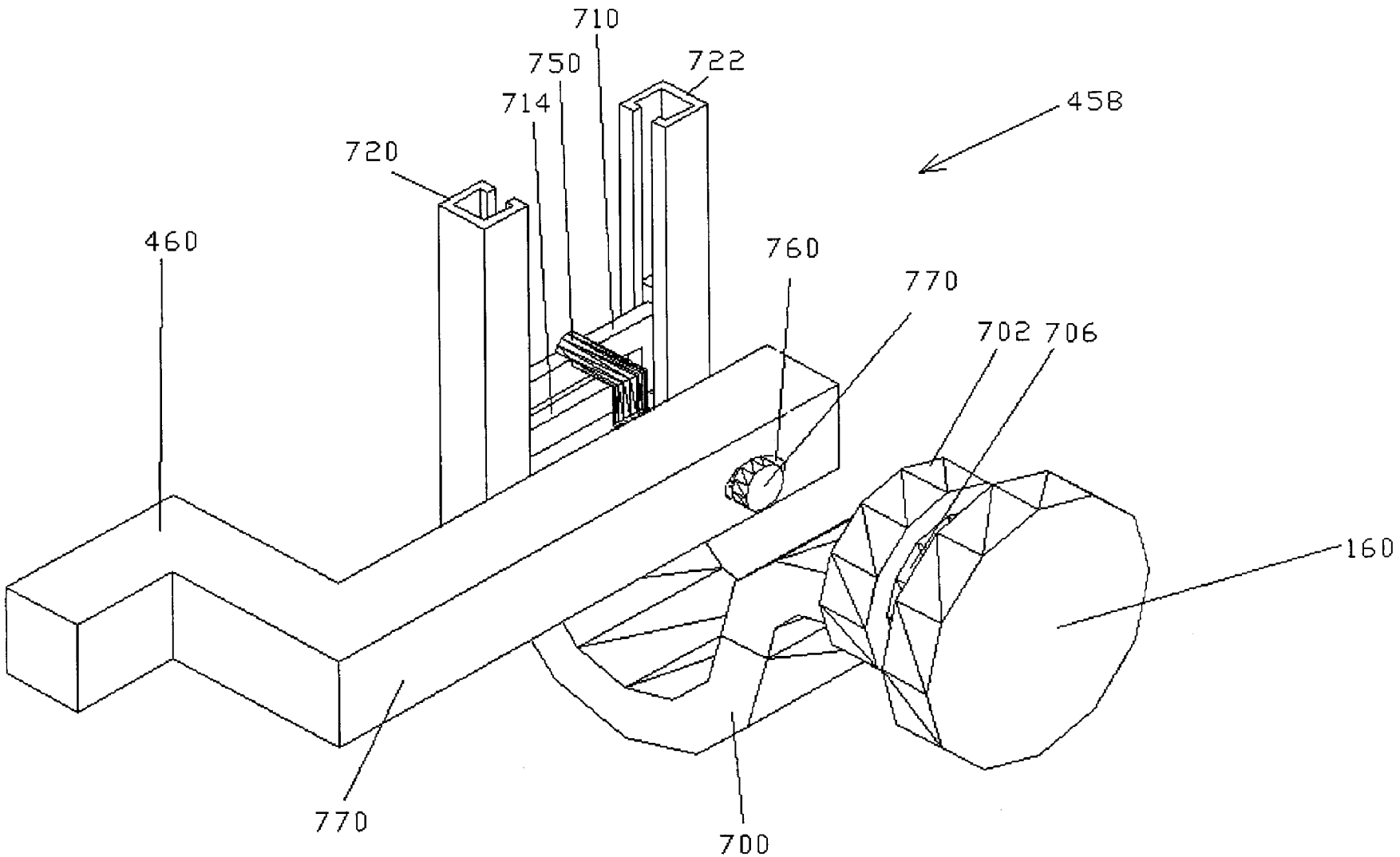
FIG. 8 is a fragmental perspective view of the reciprocator of FIG. 7.
Figure 9:
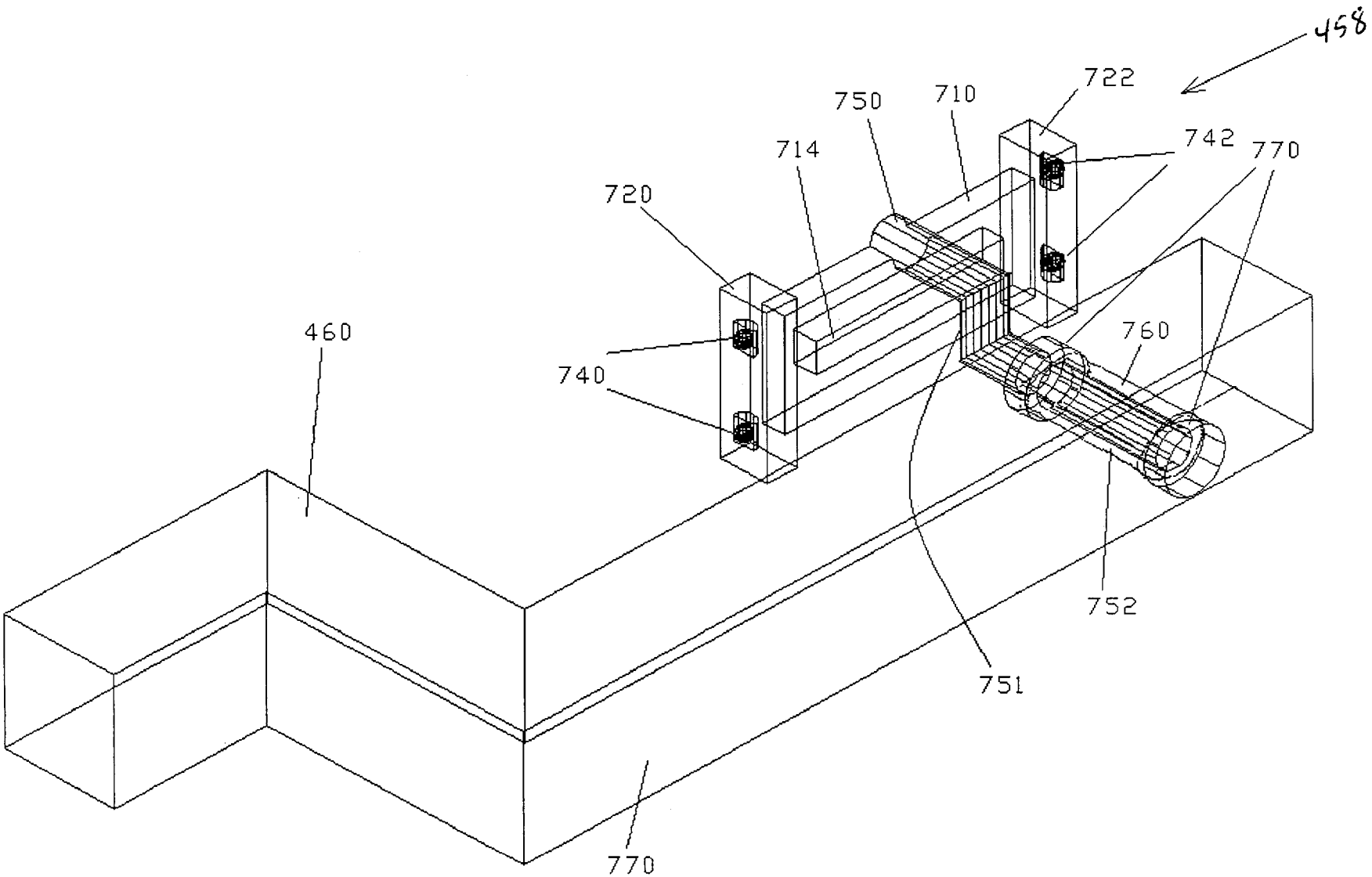
FIG. 9 is a fragmental perspective view showing a specially shaped pin in accordance with an embodiment of the invention.

With reference to FIGS. 7–9 the structure of the reciprocator 458 will now be described. Reciprocator 458 includes a U-shaped body section 700 shaped to accommodate rocker arm 460. Reciprocator 458 is rotatably attachable to the elongated housing 102 by means of a fixed wheel 702 formed at a housing end 704 of the U-shaped body section 700 in spaced relationship to the adjusting button 160. A connecting portion 706 (FIG. 8) separates the fixed wheel 702 and the adjusting button 160 and is disposed in an aperture 708 (FIG. 4) formed in the wall 416 of the elongated housing 102 in such manner that the fixed wheel 702 is disposed inside the gear compartment 403 and the adjusting button 160 is disposed outside the elongated housing 102.

A reciprocating bridge 710 is shown formed at a bridge end 712 of the U-shaped body section 700. The reciprocating bridge 710 includes a sliding slot 714 adapted to accommodate the pin 451. The reciprocating bridge 710 extends between a pair of supports 720, 722 which are adapted to receive reciprocating bridge ends 730, 732. Reciprocating bridge ends 730, 732 further include bearings 740, 742 which enable reciprocating bridge ends 730, 732 to slide within supports 720, 722.

With reference to FIG. 9 reciprocating bridge 710 further includes a specially shaped pin 750 coupled thereto. Specially shaped pin 750 includes a jogged portion 751 and a rocker arm portion 752. Rocker arm portion 752 is receivable in a rocker arm slot 760 formed at a reciprocating bridge portion 770 of the rocker arm 460. Rocker arm slot 760 preferably has a larger diameter than rocker arm portion 752 to accommodate motion of the rocker arm portion 752 therein. The rocker arm portion 752 of the specially shaped pin 750 further includes a pair of barriers 770 formed and disposed on the rocker arm portion 752 in such manner so as to prevent the rocker arm portion 752 from sliding out of the rocker arm slot 760.

Figure 10:
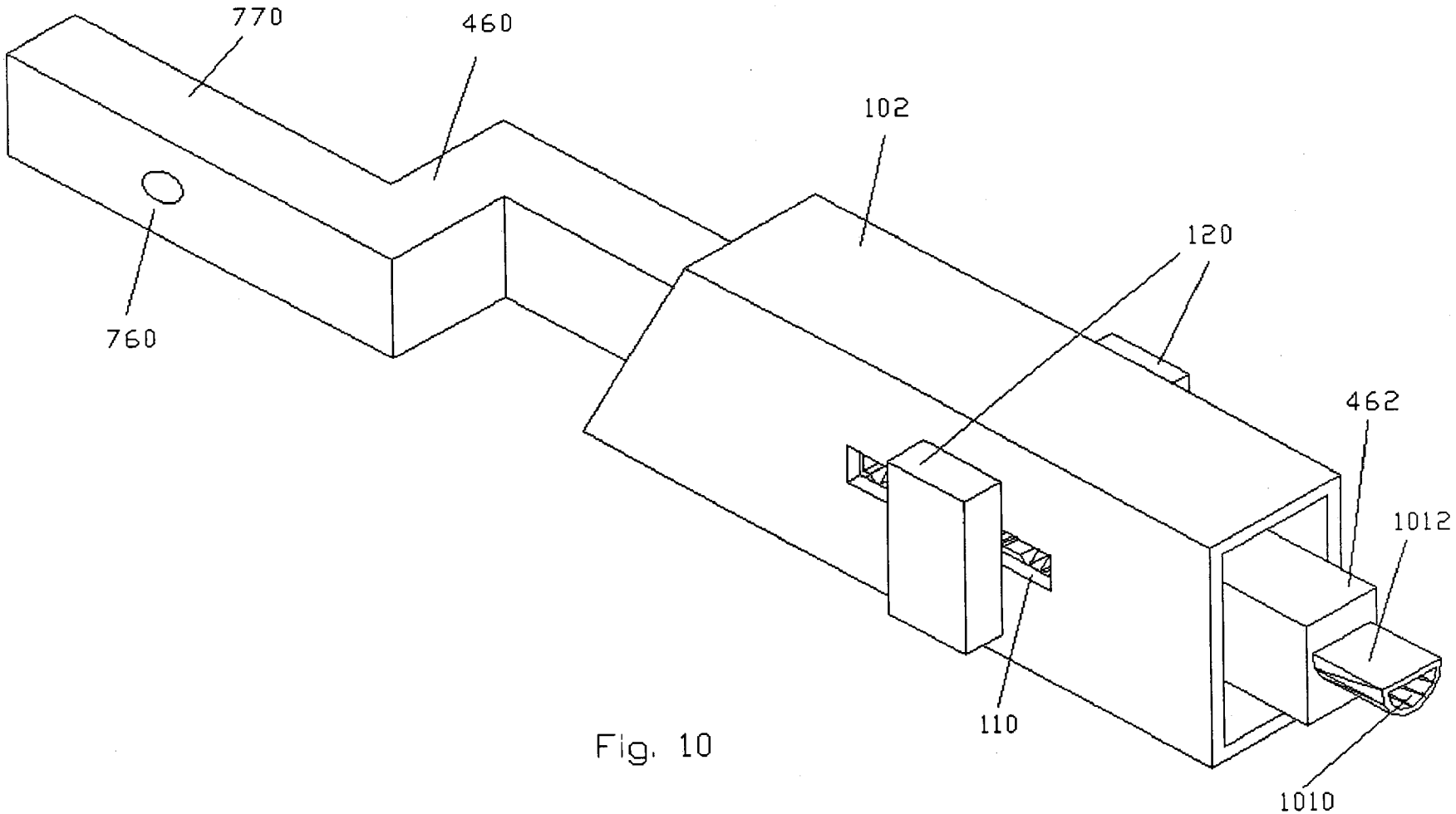
FIG. 10 is a fragmental perspective view of a pivot mechanism in accordance with an embodiment of the invention.
Figure 11:
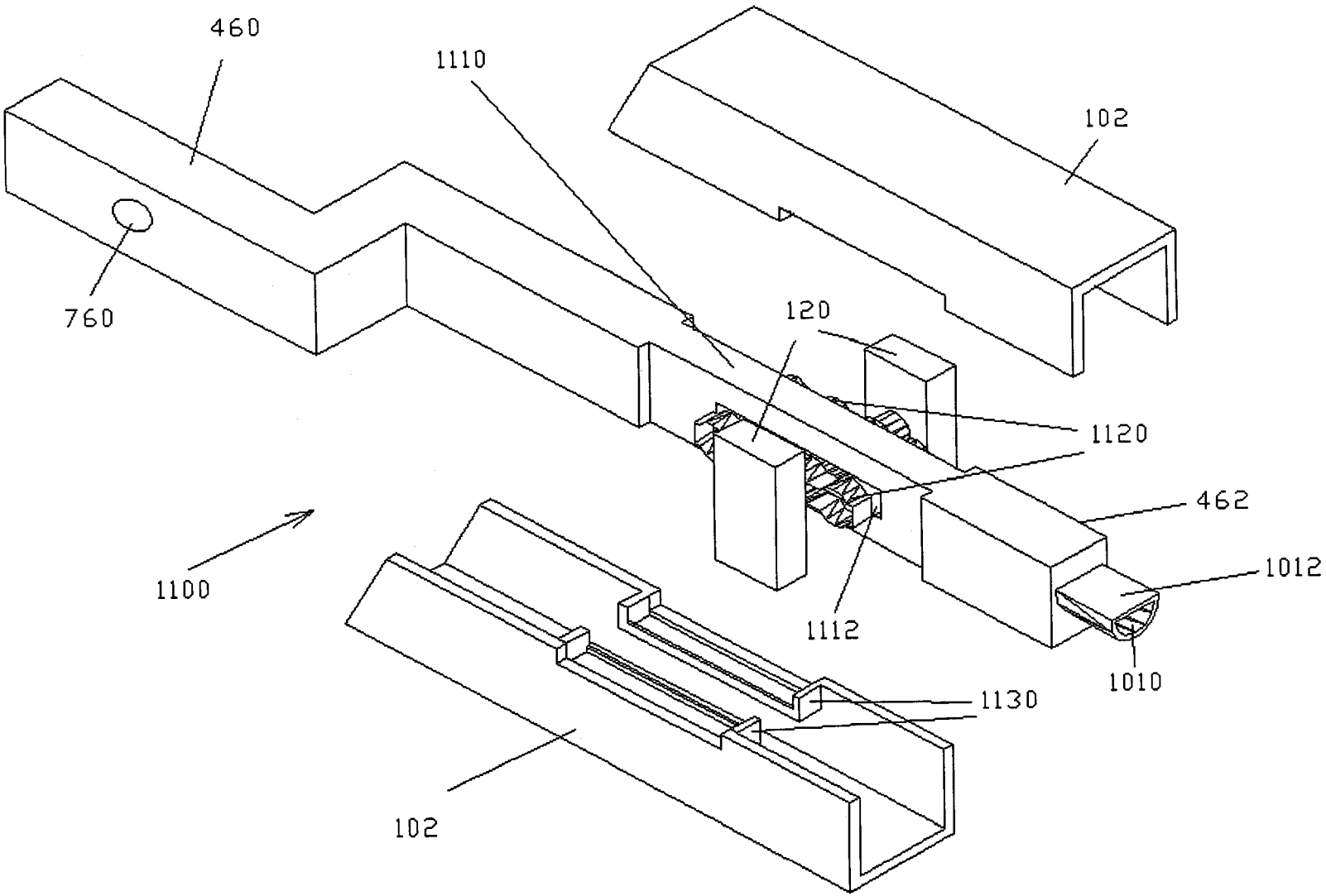
FIG. 11 is an exploded fragmental perspective view of the pivot mechanism of FIG. 10.
Figure 12:
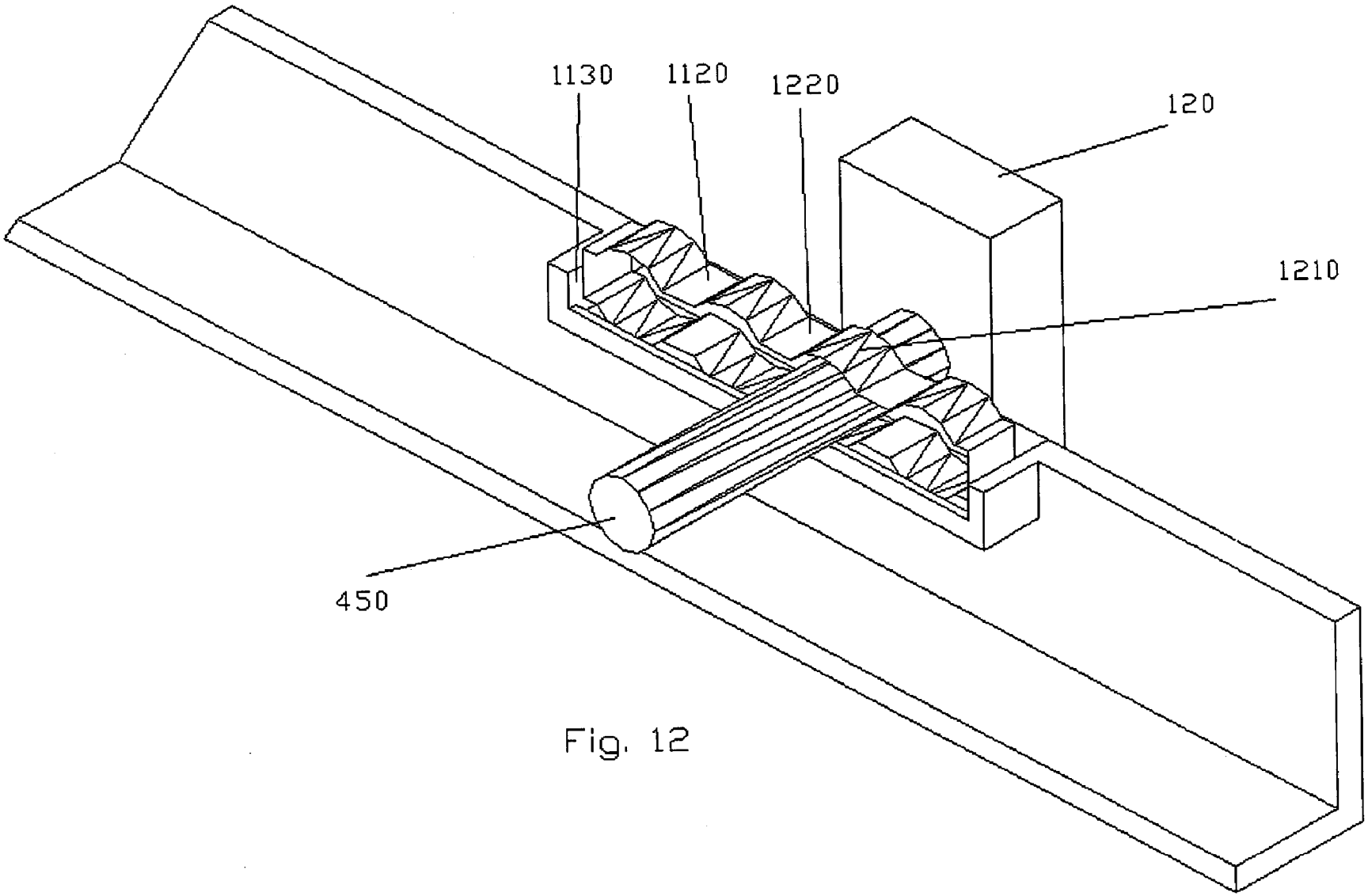
FIG. 12 is a fragmental perspective view of a spring chamber in accordance with an embodiment of the invention.

With reference to FIGS. 10–12, the structure of a pivot mechanism generally designated 1100 will be described. Pivot mechanism 1100 is shown disposed proximate the attachment end 462 of rocker arm 460. A narrowed portion 1110 of rocker arm 460 includes a pivot pin slot 1112 through which the pivot pin 450 is received.

A pair of spring chambers 1120 include a plurality of holding areas 1210 separated by restraining areas 1220. Spring chambers 1120 are receivable in spring chamber receiving areas 1130 formed in elongated housing 102 proximate the attachment end 462. Pivot pin 450 is positionably receivable in holding areas 1210 to impart different ranges of motion to the flossing head 104 and the brushing head 106 when the multifunction dental cleaning device 100 is operated in the vertical motion mode as further described herein. In the horizontal motion mode, the position of pivot pin 450 does not affect operation of the multifunction dental cleaning device 100, the pivot pin 450 providing a surface upon which the rocker arm may slide.

With reference to FIGS. 1 and 4, the flossing head 104 includes a Y-shaped body 470 to which is attachable a dental floss 472. A pair of legs 476 may be downwardly disposed relative to a main body portion 478. A connection end 474 of Y-shaped body 470 is frictionally receivable within a slot 1010 (FIG. 10) formed in an attachment end 462 of the rocker arm 460. The brushing head 106 includes bristles 480 and a connection end 482 frictionally attachable to support structure 1012 (FIG. 10).

Operation of the multifunction dental cleaning device 100 will now be described. As shown in FIG. 4, reciprocator 458 is disposed in vertical motion mode. Powering the motor 400 results in the transference of motion through the drive mechanism 490 to motion of pin 451 within sliding slot 714 which in turn moves reciprocating bridge 710 in a reciprocating manner. The reciprocating motion of reciprocating bridge 710 in translated to the rocker arm 460 which pivots around pivot pin 450. Manual positioning of pivot pin 450 within holding areas 1210 determines the range of vertical motion of either flossing head 104 or brushing head 106 attached to attachment end 462.

Operation in the horizontal motion mode is achievable by manually turning adjusting button 160 counterclockwise such that reciprocator 458 is oriented exactly 90 degrees relative to the position shown in FIG. 4. In horizontal motion mode the reciprocating bridge 710 moves in a reciprocating manner and this motion is translated to the rocker arm 460 which moves horizontally along pivot pin 450. Operation in horizontal motion mode advantageously moves brushing head 106 horizontally for effective brushing to the teeth.

Figure 2:
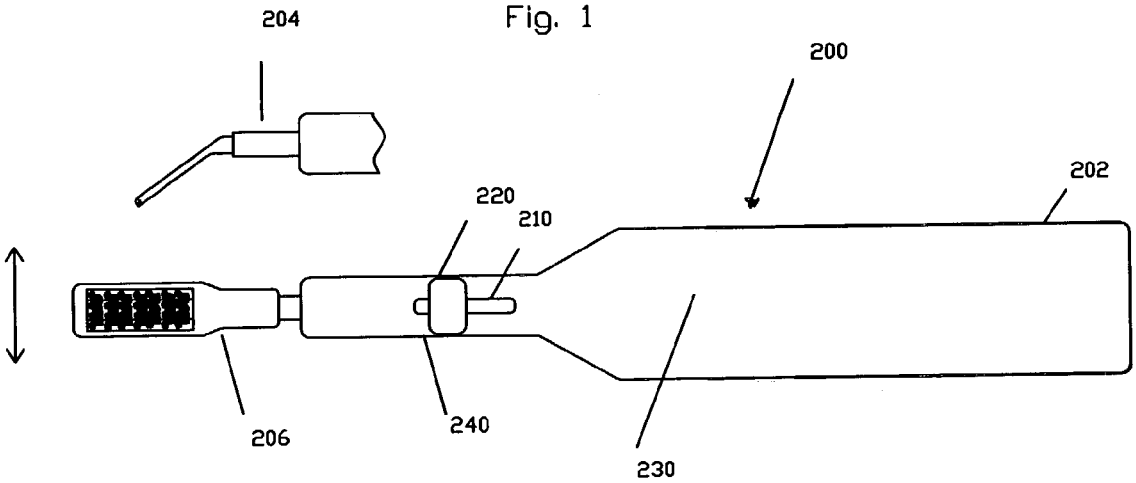
FIG. 2 is a fragmental side elevation view of the multifunction dental cleaning device in accordance with another embodiment of the invention.

With reference to FIG. 2, a preferred embodiment of a multifunction dental cleaning device generally designated 200 is shown including an elongated housing 202 for housing drive mechanism 1390 (FIG. 13) as further described herein. A flossing head 204 and a brushing head 206 may be alternatively attached to a rocker arm 1360 (FIG. 13) to achieve vertical motion of the flossing head 204 and the brushing head 206.

Figure 13:
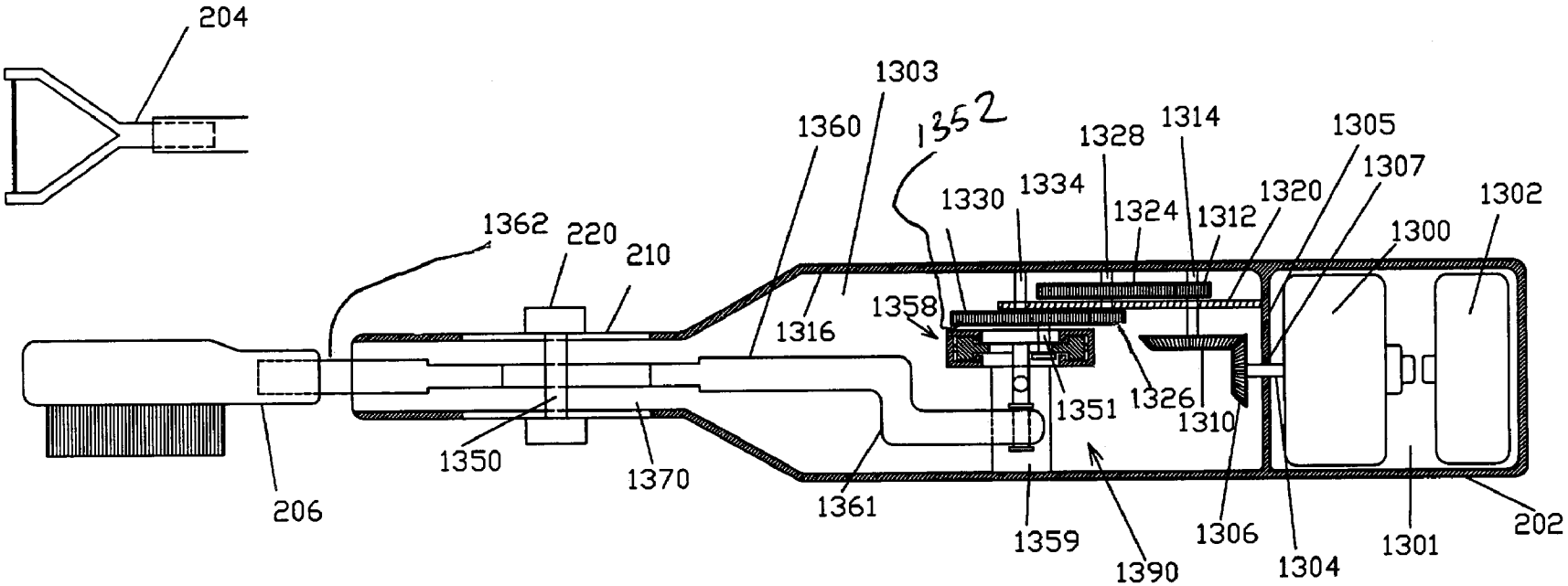
FIG. 13 is a fragmental top elevation view, partly in section, of the multifunction dental cleaning device of FIG. 2 showing the drive mechanism in accordance with the invention.

The elongated housing 202 further includes a sliding slot 210 for accommodating a positionalbe pivot pin 1350 (FIG. 13). A pair of handles 220 (FIG. 2) are attachable to either end of the pivot pin 1350 and are shown disposed adjacent an outside surface 230 of the elongated housing 202 proximate a narrow portion 240 of the elongated housing 202. The function of the pivot pin 1350 and the handles 220 will be further described herein.

Figure 15:
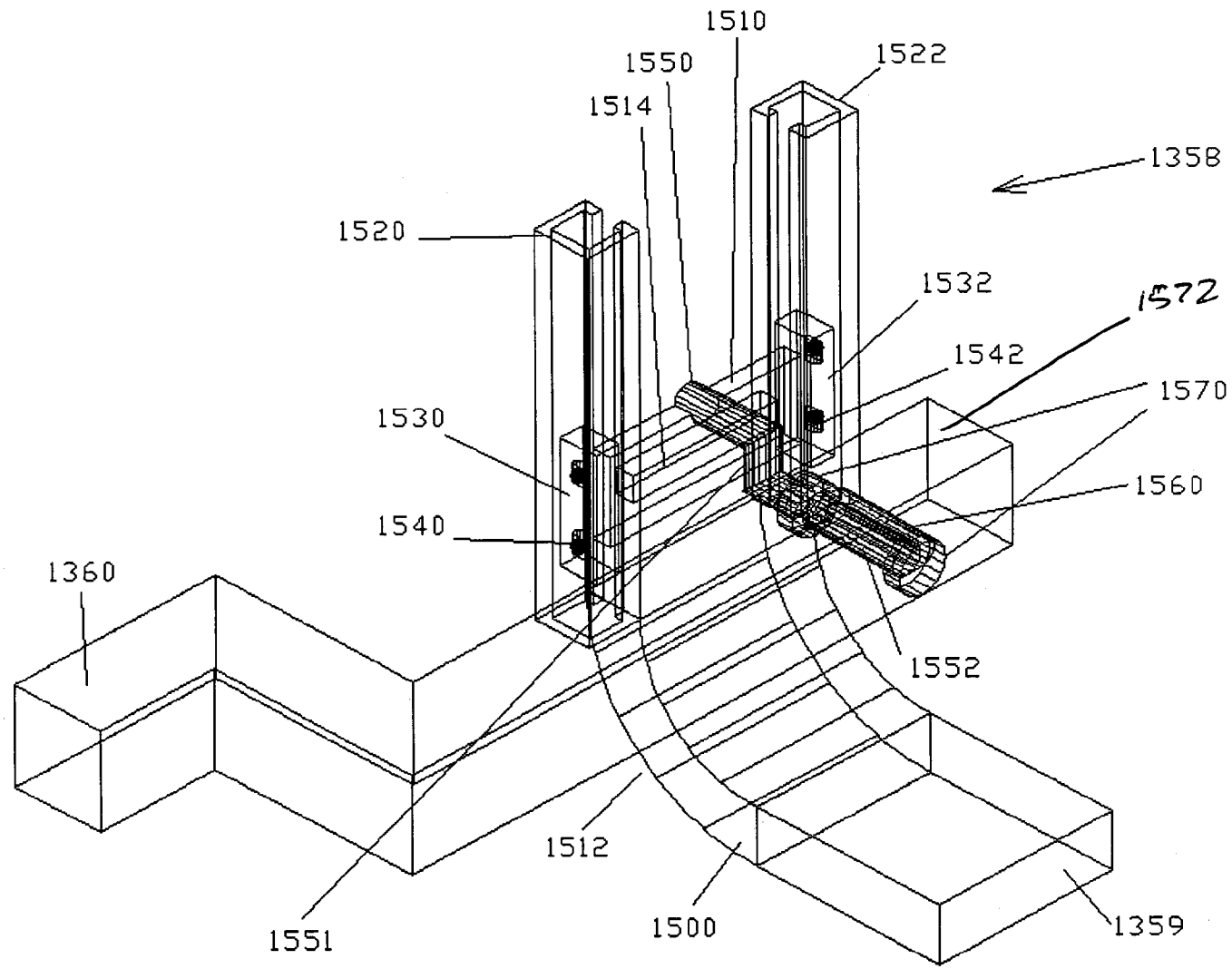
FIG. 15 is a fragmental perspective view of a reciprocator in accordance with an alternative embodiment of the invention shown in ghost image.

With reference to FIGS. 13 and 15, a preferred embodiment of the present invention is shown including the drive mechanism 1390 including a motor 1300 disposed within the elongated housing 202 in a motor/battery compartment 1301. The motor/battery compartment 1301 may be separated from a gear compartment 1303 by a wall 1305. The motor 1300 may be powered by a battery 1302 coupled to the motor 1300 through a switch (not shown).

The motor 1300 is shown including a motor drive shaft 1304 for coupling the motor 1300 to a first bevel pinion gear 1306. Drive shaft 1304 extends through wall 1305 through an aperture 1307. The first bevel pinion gear 1306 is coupled to a first driven bevel gear 1310 which in turn is coupled to a first spur gear 1312 by means of a first gear shaft 1314. First gear shaft 1314 is bearingly coupled to an inside wall 1316 of the elongated housing 202 and to a gear supporting structure 1320 shown extending from the wall 1305 into the gear compartment 1303.

First spur gear 1312 is coupled to a first driven gear 1324 which in turn is coupled to a second spur gear 1326 by means of a second gear shaft 1328. Second gear shaft 1328 is bearingly coupled to the inside wall 1316 and to the gear supporting structure 1320.

Second spur gear 1326 is coupled to a second driven gear 1330, the second driven gear 1330 being positioned within the gear compartment 1303 by means of a third gear shaft 1334. Third gear shaft 1334 is bearingly coupled to the inside wall 1316 and to the gear supporting structure 1320.

The second driven gear 1330 is shown including a pin 1351 eccentrically disposed on a bottom surface 1352 thereof. Pin 1351 is engageable to a reciprocator generally designated 1358 which will be described in further detail herein.

With continued reference to FIGS. 13 and 15, a rocker arm 1360 is shown extending from the reciprocator 1358 through the gear compartment 1303 into a forward compartment 1370. Rocker arm 1360 includes a jogged portion 1361. Flossing head 204 and the brushing head 206 are attachable to an attachment end 1362 of the rocker arm 1360 in similar fashion as flossing head 104 and brushing head 106 are attachable to attachment end 462.

Figure 14:
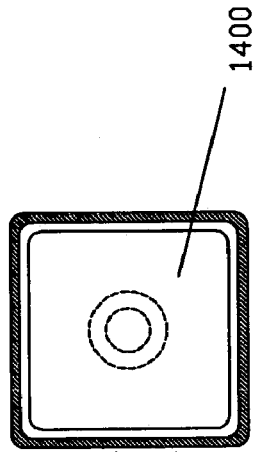
FIG. 14 is a rear elevation view of the multifunction dental cleaning device of FIG. 2.

With reference to FIG. 14, a back portion 1400 of the elongated housing 202 is shown having a generally square profile. Back portion 1400 may be removeable or openable to replace battery 1302 in any conventional manner well known in the art.

With particular reference to FIG. 15 the structure of the reciprocator 1358 will now be described. Reciprocator 1358 includes a half-U-shaped body section 1500 shaped to accommodate rocker arm 1360. Reciprocator 1358 is fixedly attachable to the inside wall 1316 at an end 1359 thereof. A length of end 1359 is disposed generally in a plane parallel to that of a lengthwise intersecting plane of the rocker arm 1360 such that vertical motion of the flossing head 204 and brushing head 206 is achieved as further described herein.

A reciprocating bridge 1510 is shown formed at a bridge end 1512 of the body section 1500. The reciprocating bridge 1510 includes a sliding slot 1514 adapted to accommodate the pin 1351. The reciprocating bridge 1510 extends between a pair of supports 1520, 1522 which are adapted to receive reciprocating bridge ends 1530, 1532. Reciprocating bridge ends 1530, 1532 further include bearings 1540, 1542 which enable reciprocating bridge ends 1530, 1532 to slide within supports 1520, 1522.

Reciprocating bridge 1510 further includes a specially shaped pin 1550 coupled thereto. Specially shaped pin 1550 includes a jogged portion 1551 and a rocker arm portion 1552. Rocker arm portion 1552 is receivable in a rocker arm slot 1560 formed at a reciprocating bridge portion 1572 of the rocker arm 1360. Rocker arm slot 1560 preferably has a larger diameter than rocker arm portion 1552 to accommodate motion of the rocker arm portion 1552 therein. The rocker arm portion 1552 of the specially shaped pin 1550 further includes a pair of barriers 1570 formed and disposed on the rocker arm portion 1552 in such manner so as to prevent the rocker arm portion 1552 from sliding out of the rocker arm slot 1560.

The structure of the pivot mechanism is identical to the pivot mechanism described with reference to the multifunction dental cleaning device 100 shown in FIGS. 10–12.

Furthermore, the flossing head 204 and the brushing head 206 are identical to flossing head 104 and brushing head 106 respectively.

Operation of the multifunction dental cleaning device 200 will now be described. Powering the motor 1300 results in the transfer of motion through the drive mechanism 1390 to motion of pin 1351 within sliding slot 1514 which in turn moves reciprocating bridge 1510 in a reciprocating manner. The reciprocating motion of reciprocating bridge 1510 in translated to the rocker arm 1360 which pivots around pivot pin 1350. Positioning of pivot pin 1350 determines the range of vertical motion of either flossing head 204 or brushing head 206.

Figure 3:
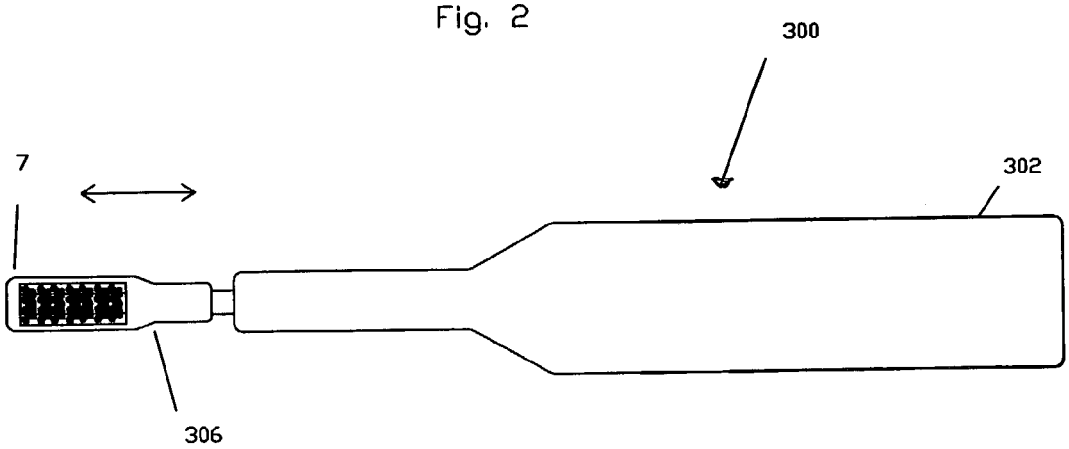
FIG. 3 is a fragmental side elevation view of the multifunction dental cleaning device in accordance with another embodiment of the invention.

With reference to FIG. 3, a preferred embodiment of a multifunction dental cleaning device generally designated 300 is shown including an elongated housing 302 for housing a drive mechanism 1690 (FIG. 16) as further described herein. A brushing head 306 may be attached to a rocker arm 1660 (FIG. 16) to achieve horizontal motion of the brushing head 306.

Figure 16:
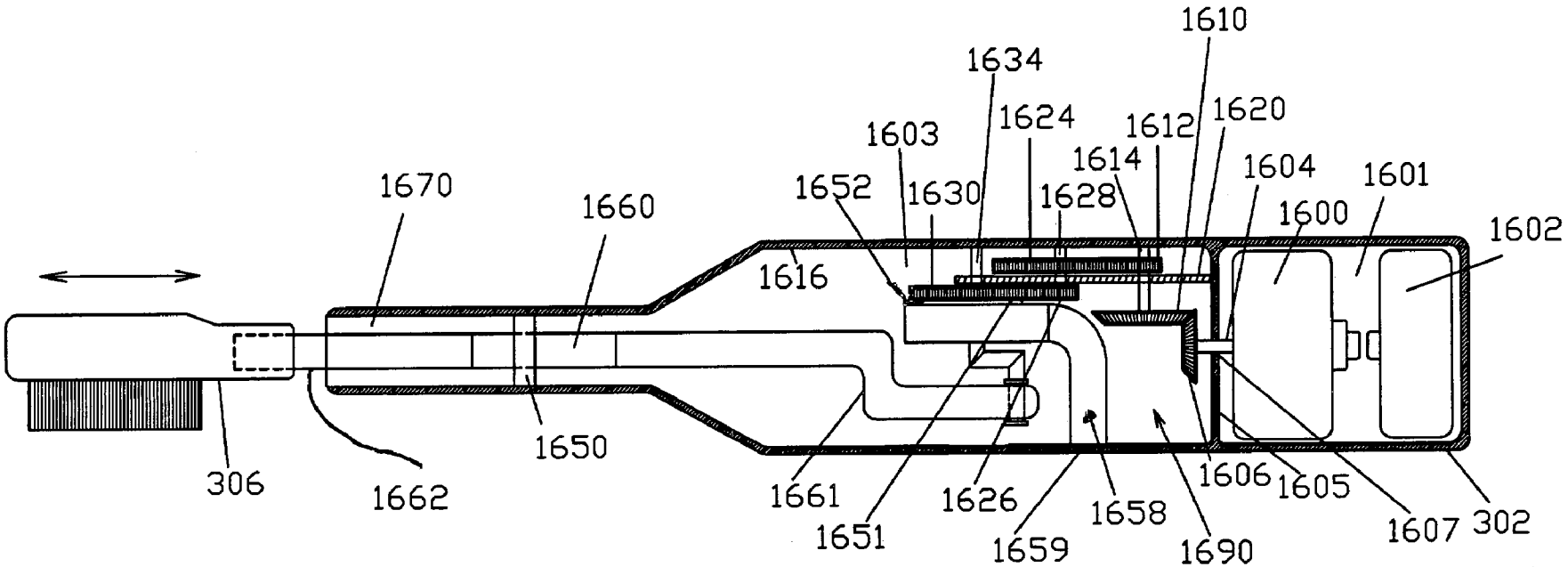
FIG. 16 is a fragmental top elevation view, partly in section, of the multifunction dental cleaning device of FIG. 3 showing the drive mechanism in accordance with the invention.
Figure 18:
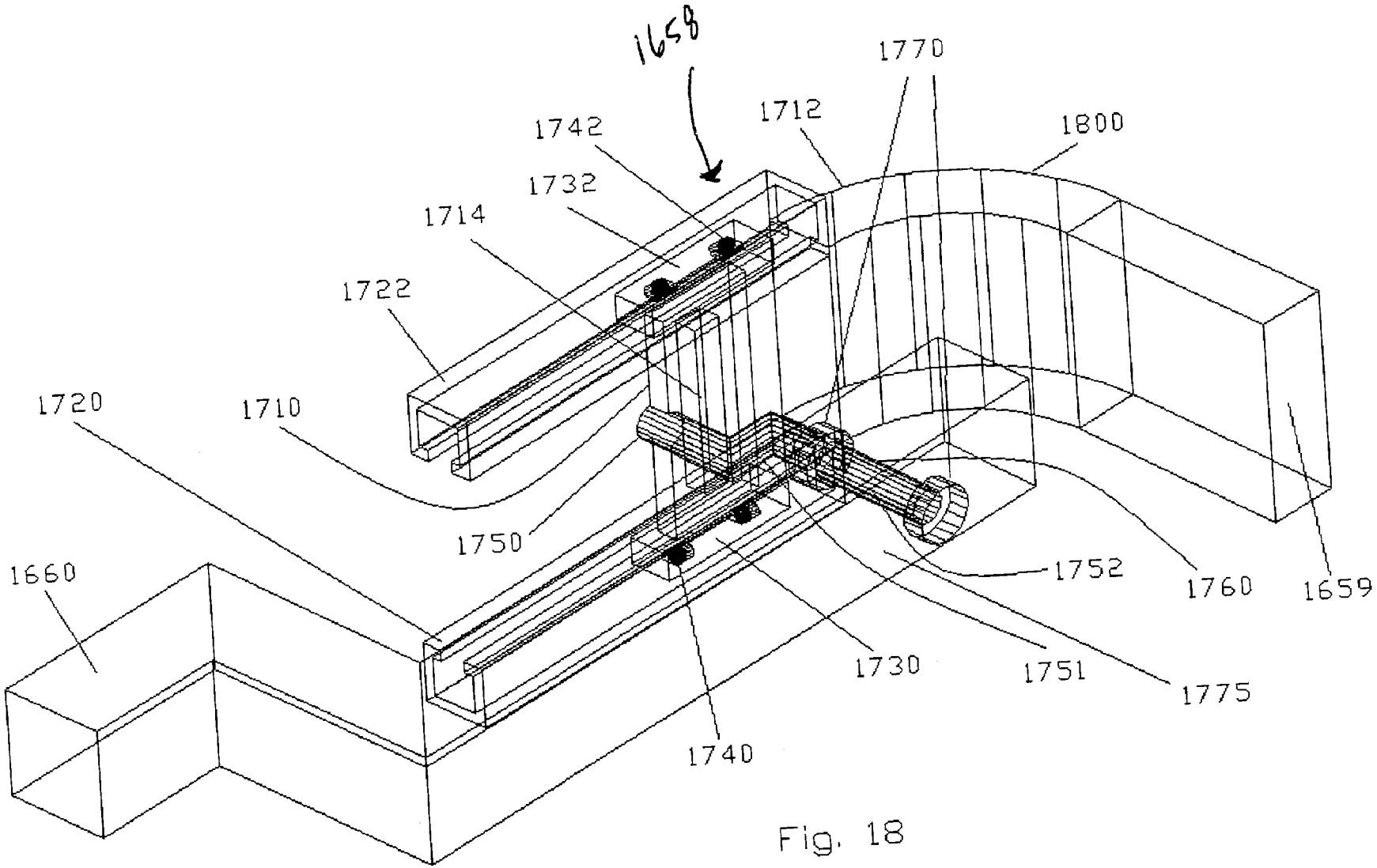
FIG. 18 is a fragmental perspective view of a reciprocator in accordance with an alternative embodiment of the invention shown in ghost image.

With reference to FIGS. 16 and 18, a preferred embodiment of the present invention is shown including the drive mechanism 1690 including a motor 1600 disposed within the elongated housing 302 in a motor/battery compartment 1601. The motor/battery compartment 1601 may be separated from a gear compartment 1603 by a wall 1605. The motor 1600 may be powered by a battery 1602 coupled to the motor 1600 through a switch (not shown).

The motor 1600 is shown including a motor drive shaft 1604 for coupling the motor 1600 to a first bevel pinion gear 1606. Drive shaft 1604 extends through wall 1605 through an aperture 1607. The first bevel pinion gear 1606 is coupled to a first driven bevel gear 1610 which in turn is coupled to a first spur gear 1612 by means of a first gear shaft 1614. First gear shaft 1614 is bearingly coupled to an inside wall 1616 of the elongated housing 302 and to a gear supporting structure 1620 shown extending from the wall 1605 into the gear compartment 1603.

First spur gear 1612 is coupled to a first driven gear 1624 which in turn is coupled to a second spur gear 1626 by means of a second gear shaft 1628. Second gear shaft 1628 is bearingly coupled to the inside wall 1616 and to the gear supporting structure 1620.

Second spur gear 1626 is coupled to a second driven gear 1630, the second driven gear 1630 being positioned within the gear compartment 1603 by means of a third gear shaft 1634. Third gear shaft 1634 is bearingly coupled to the inside wall 1616 and to the gear supporting structure 1620.

The second driven gear 1630 is shown including a pin 1651 eccentrically disposed on a bottom surface 1652 thereof. Pin 1651 is engageable to a reciprocator generally designated 1658 which will be described in further detail herein.

With continued reference to FIGS. 16 and 18, a rocker arm 1660 is shown extending from the reciprocator 1658 through the gear compartment 1603 into a forward compartment 1670. Rocker arm 1660 includes a jogged portion 1661. The brushing head 306 may be attachable to an attachment end 1662 of the rocker arm 1660 in similar fashion as flossing head 104 and brushing head 106 are attachable to attachment end 462.

Figure 17:
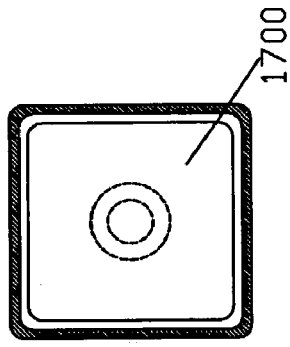
FIG. 17 is a rear elevation view of the multifunction dental cleaning device of FIG. 3.

With reference to FIG. 17, a back portion 1700 of the elongated housing 202 is shown having a generally square profile. Back portion 1700 may be removeable or openable to replace battery 1602 in any conventional manner well known in the art.

With particular reference to FIG. 18 the structure of the reciprocator 1658 will now be described. Reciprocator 1658 includes a half-U-shaped body section 1800 shaped to accommodate rocker arm 1660. Reciprocator 1658 is fixedly attachable to the inside wall 1616 at an end 1659 thereof. A length of end 1659 is disposed generally perpendicular to a lengthwise intersecting plane of the rocker arm 1660 such that horizontal motion of the brushing head 306 is achieved as further described herein.

A reciprocating bridge 1710 is shown formed at a bridge end 1712 of the body section 1700. The reciprocating bridge 1710 includes a sliding slot 1714 adapted to accommodate the pin 1651. The reciprocating bridge 1710 extends between a pair of supports 1720, 1722 which are adapted to receive reciprocating bridge ends 1730, 1732. Reciprocating bridge ends 1730, 1732 further include bearings 1740, 1742 which enable reciprocating bridge ends 1730, 1732 to slide within supports 1720, 1722.

Reciprocating bridge 1710 further includes a specially shaped pin 1750 coupled thereto. Specially shaped pin 1750 includes a jogged portion 1751 and a rocker arm portion 1752. Rocker arm portion 1752 is receivable in a rocker arm slot 1760 formed at a reciprocating bridge portion 1775 of the rocker arm 1660. Rocker arm slot 1760 preferably has a larger diameter than rocker arm portion 1752 to accommodate motion of the rocker arm portion 1752 therein. The rocker arm portion 1752 of the specially shaped pin 1750 further includes a pair of barriers 1770 formed and disposed on the rocker arm portion 1752 in such manner so as to prevent the rocker arm portion 1752 from sliding out of the rocker arm slot 1760.

Operation of the multifunction dental cleaning device 300 will now be described. Powering the motor 1600 results in the transfer of motion through the drive mechanism 1690 to motion of pin 1651 within sliding slot 1714 which in turn moves reciprocating bridge 1710 in a reciprocating manner. The reciprocating motion of reciprocating bridge 1710 in translated to the rocker arm 1660 which slides horizontally along a pivot pin 1650 (FIG. 16) thereby imparting horizontal motion to the brushing head 206.

Figure 19:
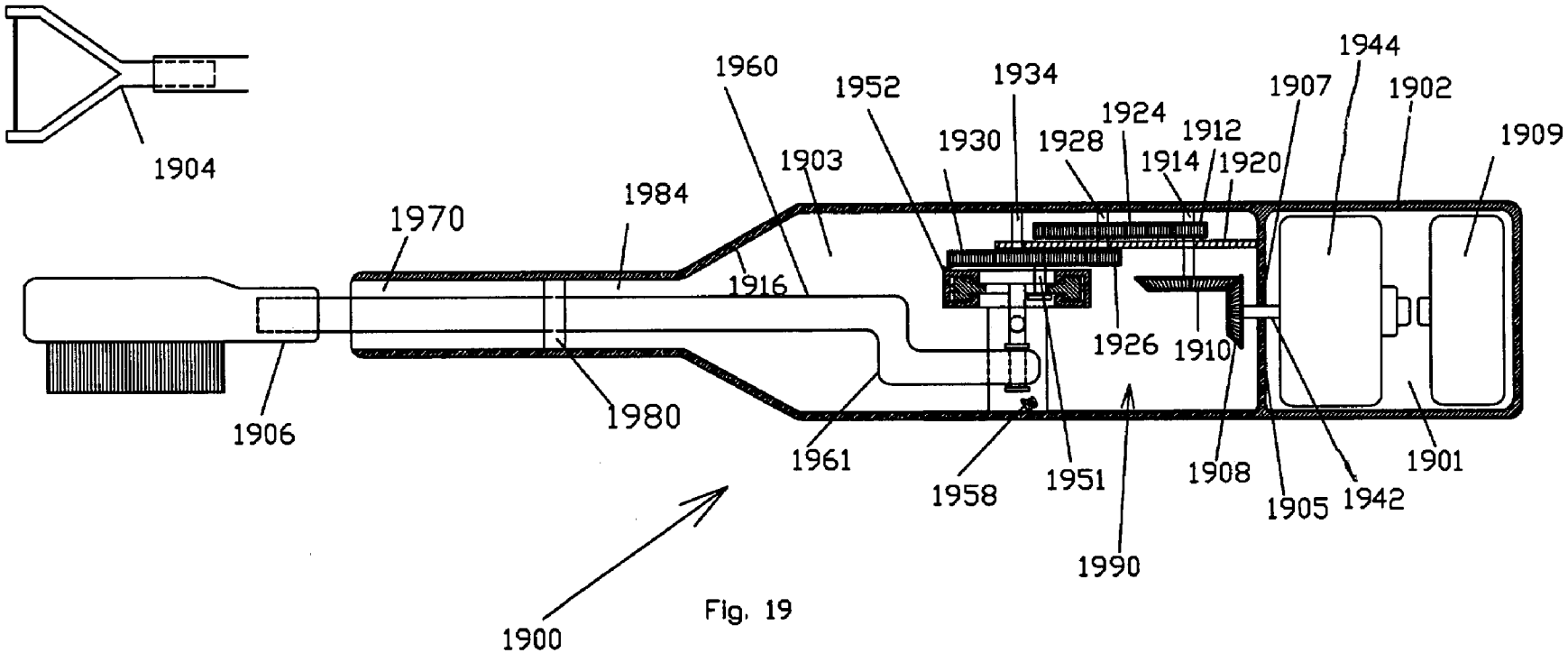
FIG. 19 is a fragmental top elevation view, partly in section, of a multifunction dental cleaning device of showing the drive mechanism in accordance with an alternative embodiment of the invention.

With reference to FIG. 19, a preferred embodiment of a multifunction dental cleaning device generally designated 1900 is shown including an elongated housing 1902 for housing a drive mechanism generally designated 1990 as further described herein. A flossing head 1904 and a brushing head 1906 may be alternatively attached to a rocker arm 1960 to achieve vertical motion of the flossing head 1904 and the brushing head 1906.

Drive mechanism 1990 includes a motor 1944 disposed within the elongated housing 1902 in a motor/battery compartment 1901. The motor/battery compartment 1901 may be separated from a gear compartment 1903 by a wall 1905. The motor 1944 may be powered by a battery 1909 coupled to the motor 1944 through a switch (not shown).

The motor 1944 is shown including a motor drive shaft 1942 for coupling the motor 1944 to a first bevel pinion gear 1908. Drive shaft 1942 extends through wall 1905 through an aperture 1907. The first bevel pinion gear 1908 is coupled to a first driven bevel gear 1910 which in turn is coupled to a first spur gear 1912 by means of a first gear shaft 1914. First gear shaft 1914 is bearingly coupled to an inside wall 1916 of the elongated housing 1902 and to a gear supporting structure 1920 shown extending from the wall 1905 into the gear compartment 1903.

First spur gear 1912 is coupled to a first driven gear 1924 which in turn is coupled to a second spur gear 1926 by means of a second gear shaft 1928. Second gear shaft 1928 is bearingly coupled to the inside wall 1916 and to the gear supporting structure 1920.

Second spur gear 1926 is coupled to a second driven gear 1930, the second driven gear 1930 being positioned within the gear compartment 1903 by means of a third gear shaft 1934. Third gear shaft 1934 is bearingly coupled to the inside wall 1916 and to the gear supporting structure 1920.

The second driven gear 1930 is shown including a pin 1951 eccentrically disposed on a bottom surface 1952 thereof. Pin 1951 is engageable to a reciprocator generally designated 1958 which will be described in further detail herein.

With continued reference to FIG. 19, the rocker arm 1960 is shown extending from the reciprocator 1958 through the gear compartment 1903 into a forward compartment 1970. Rocker arm 1960 includes a jogged portion 1961. Flossing head 1904 and the brushing head 1906 are attachable to an attachment end 1962 of the rocker arm 1960 in similar fashion as flossing head 104 and brushing head 106 are attachable to attachment end 462.

Figure 20:
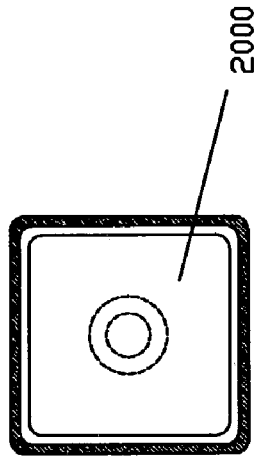
FIG. 20 is a rear elevation view of the multifunction dental cleaning device of FIG. 19.

With reference to FIG. 20, a back portion 2000 of the elongated housing 1902 is shown having a generally square profile. Back portion 2000 may be removeable or openable to replace battery 1909 in any conventional manner well known in the art.

With particular reference to FIG. 19 the structure of the reciprocator 1958 is shown to be identical to the structure of reciprocator 1358. A pivot pin 1980 may be disposed in a forward compartment 1984. Furthermore, the flossing head 1904 and the brushing head 1906 are identical to flossing head 104 and brushing head 106 respectively.

Operation of the multifunction dental cleaning device 1900 will now be described. Powering the motor 1944 results in the transfer of motion through the drive mechanism 1990 to motion of pin 1951 within sliding slot (not shown) which in turn moves reciprocating bridge (not shown) in a reciprocating manner. The reciprocating motion of reciprocating bridge in translated to the rocker arm 1960 which pivots around pivot pin 1980. As the pivot pin 1980 is stationary, the extent of vertical range of the flossing head 1904 and/or the brushing head 1906 is predefined.

As shown, the multifunction dental cleaning device of the invention overcomes the deficiencies of the prior art by providing a dental cleaning device capable of flossing and brushing teeth and the spaces between teeth from a variety of angles and directions. It should be understood, of course, that the foregoing relates to preferred embodiments of the invention and that modifications may be made without departing from the spirit and scope of the invention. Any such modifications should in no way limit the scope of the invention, which should only be determined based on the following claims.

I claim:

1. A multifunction dental cleaning device comprising:

a housing;

a drive mechanism disposed within the housing, the drive mechanism comprising a driven gear having eccentrically disposed thereon a pin;

a reciprocator coupled to the drive mechanism, the reciprocator comprising a U-shaped body having a bridge end and a housing end, the reciprocator further comprising a reciprocating bridge slidingly disposed between a pair of supports formed at the bridge end of the reciprocator, the reciprocating bridge including a slot adapted to receive the pin, the reciprocator being rotatably attached to the housing at the bridge end;

a rocker arm coupled to the reciprocating bridge, the rocker arm comprising a pivot mechanism disposed proximate an attachment end thereof; and one of a flossing head and a brushing head coupleable to the rocker arm at the attachment end thereof.

2. The multifunction dental cleaning device of claim 1, wherein the reciprocator is positionable within the housing to impart reciprocating horizontal motion to the rocker arm, the rocker arm sliding along the pivot mechanism.

3. The multifunction dental cleaning device of claim 1, wherein the reciprocator is positionable within the housing to impart reciprocating vertical motion to the rocker arm, the rocker arm pivoting about the pivot mechanism.

4. The multifunction dental cleaning device of claim 1, wherein the pivot mechanism further comprises a positionable pivot pin, the positionable pivot pin being receivable in one of a plurality of holding areas separated by restraining areas formed in a spring chamber.

5. The multifunction dental cleaning device of claim 1, wherein the reciprocator imparts vertical motion to the rocker arm in a vertical mode motion position and imparts horizontal motion to the rocker arm in a horizontal mode motion position, the reciprocator being manually adjustable between the vertical mode motion position and the horizontal mode motion position.

* * * * *